US010414114B1

(12) United States Patent
Yoo et al.

(10) Patent No.: US 10,414,114 B1
(45) Date of Patent: Sep. 17, 2019

(54) LABELS FOR USE IN HOT AND COLD EXTREMES AND METHODS OF MAKING SAME

(71) Applicant: WARD KRAFT, INC., Fort Scott, KS (US)

(72) Inventors: Young Min Yoo, Fort Scott, KS (US); Jesse Crum, Fort Scott, KS (US)

(73) Assignee: Ward Kraft, Inc., Fort Scott, KS (US)

( * ) Notice: Subject to any disclaimer, the term of this patent is extended or adjusted under 35 U.S.C. 154(b) by 128 days.

(21) Appl. No.: 15/797,475

(22) Filed: Oct. 30, 2017

Related U.S. Application Data

(60) Provisional application No. 62/414,044, filed on Oct. 28, 2016.

(51) Int. Cl.
*B31D 1/02* (2006.01)
*G09F 3/02* (2006.01)

(52) U.S. Cl.
CPC ..... *B31D 1/021* (2013.01); *G09F 3/02* (2013.01)

(58) Field of Classification Search
USPC ..... 156/230, 231, 232, 234, 235, 238, 247, 156/249
See application file for complete search history.

(56) References Cited

U.S. PATENT DOCUMENTS 3,174,888 A * 3/1965 Morgan ..... B65C 9/18 156/230
4,771,891 A * 9/1988 Sorensen ..... B65D 5/708 156/291
4,889,234 A * 12/1989 Sorensen ..... B65D 5/708 206/459.5
5,351,426 A * 10/1994 Voy ..... B31D 1/021 40/630
5,376,418 A * 12/1994 Rogers ..... G09F 3/20 428/343
5,507,901 A * 4/1996 Limina ..... B32B 37/1292 156/200
5,591,290 A * 1/1997 Walter ..... C09J 7/403 156/152
5,595,810 A * 1/1997 Beinert ..... B32B 37/0076 156/219
5,618,600 A * 4/1997 Denklau ..... G09F 3/10 428/343
5,683,774 A * 11/1997 Faykish ..... G03H 1/0011 283/101
5,731,058 A * 3/1998 Juso ..... G09F 3/10 428/156

(Continued)

*Primary Examiner* — Sing P Chan
(74) *Attorney, Agent, or Firm* — Lathrop Gage L.L.P.

(57) ABSTRACT

A method for making a dual temperature label having a face stock and a liner comprises using a first adhesive pattern applicator to apply a first adhesive to the line. The method includes transferring the first adhesive from the liner to the face stock via a first chill roller. A second adhesive pattern applicator is used to apply a second adhesive to the liner after the first adhesive has been transferred therefrom to the face stock. The face stock is brought in registry with the liner via a second chill roller to make the dual temperature label such that each of the first adhesive and the second adhesive is sandwiched between the face stock and the liner. The first adhesive is a hot temperature adhesive and the second adhesive is a cold temperature adhesive, or vice versa.

22 Claims, 7 Drawing Sheets

(56) References Cited

U.S. PATENT DOCUMENTS 5,738,383 A * 4/1998 Main ..... G09F 3/10 283/101
6,017,408 A * 1/2000 Rogers ..... G09F 3/20 156/248
6,284,337 B1 * 9/2001 Lorimor ..... G03H 1/0011 283/107
6,730,396 B2 * 5/2004 Maloney ..... C09J 7/20 428/343
8,573,276 B2 * 11/2013 Wade ..... B65C 9/1896 156/521
9,558,681 B2 * 1/2017 Tobol ..... B31D 1/027
10,249,222 B2 * 4/2019 Tobol ..... B31D 1/027
2002/0142156 A1 * 10/2002 Maloney ..... C09J 7/20 428/343
2004/0033326 A1 * 2/2004 Tataryan ..... B42D 5/027 428/42.3
2004/0182505 A1 * 9/2004 Greenhill ..... B65C 9/188 156/230
2004/0209075 A1 * 10/2004 Maloney ..... C09J 7/20 428/343
2006/0110565 A1 * 5/2006 Tataryan ..... B42D 5/027 428/42.3
2006/0234014 A1 * 10/2006 Liu ..... B65D 33/34 428/195.1
2008/0025778 A1 * 1/2008 Ito ..... B41J 3/4075 400/76
2008/0307686 A1 * 12/2008 Wade ..... B65C 9/1896 40/638
2009/0162595 A1 * 6/2009 Ko ..... B05C 5/0254 428/41.9
2012/0135208 A1 * 5/2012 Hillereau ..... B44C 1/105 428/203
2015/0072097 A1 * 3/2015 Tobol ..... B31D 1/027 428/41.8
2017/0084207 A1 * 3/2017 Tobol ..... B31D 1/027
2018/0207953 A1 * 7/2018 Schutz ..... B31D 1/027

* cited by examiner

LABELS FOR USE IN HOT AND COLD EXTREMES AND METHODS OF MAKING SAME

CROSS REFERENCE TO RELATED APPLICATIONS

This application claims priority to U.S. Provisional Patent Application, Ser. No. 62/414,044, filed Oct. 28, 2016. The disclosure of the '044 Application is hereby incorporated by reference herein in its entirety.

FIELD OF THE DISCLOSURE

The disclosure relates generally to the field of pressure sensitive labels. More specifically, the disclosure relates to pressure sensitive labels that are usable in both hot and cold environments and to systems for making these labels.

BACKGROUND

A label for providing information about an object is configured either for hot extremes or for cold extremes. A label configured for hot extremes includes an adhesive that can withstand extremely high temperatures, but which becomes brittle and loses much of its tackiness in cold environments. A label configured for cold extremes includes an adhesive that can withstand extremely low temperatures, but which loses much of its efficacy in hot environments. Use of one of the hot temperature adhesive and the cold temperature adhesive precludes the label from being used in an application that involves both hot and cold temperature extremes.

SUMMARY

The following presents a simplified summary of the disclosure in order to provide a basic understanding of some aspects of the disclosure. This summary is not an extensive overview of the disclosure. It is not intended to identify critical elements of the disclosure or to delineate the scope of the disclosure. Its sole purpose is to present some concepts of the disclosure in a simplified form as a prelude to the more detailed description that is presented elsewhere.

In an embodiment, a method for making a dual temperature label having a face stock and a liner comprises providing a label making system. The label making system has a first adhesive pattern applicator configured to apply a first adhesive to the liner, and a second adhesive pattern applicator downstream of the first adhesive pattern applicator configured to apply a second adhesive to the liner. The label making system includes a first chill roller upstream of the second adhesive pattern applicator, and a second chill roller downstream of the second adhesive pattern applicator. The method includes using the first adhesive pattern applicator to apply the first adhesive to the liner. The method comprises transferring the first adhesive from the liner to the face stock via the first chill roller. The method includes using the second adhesive pattern applicator to apply the second adhesive to the liner after the first adhesive has been transferred therefrom to the face stock. The method comprises bringing the face stock in registry with the liner via the second chill roller to make the dual temperature label such that each of the first adhesive and the second adhesive is sandwiched between the face stock and the liner. The first adhesive is a hot temperature adhesive and the second adhesive is a cold temperature adhesive; alternately, the first adhesive is a cold temperature adhesive and the second adhesive is a hot temperature adhesive.

In another embodiment, a system for making a dual temperature label having a face stock and a liner comprises a first adhesive pattern applicator configured to apply a first adhesive to the liner. The system has a second adhesive pattern applicator downstream of the first adhesive pattern applicator configured to apply a second adhesive to the liner. The system includes a first chill roller downstream of the first adhesive pattern applicator. The first chill roller is configured to allow for the first adhesive applied to the liner to be transferred to the face stock. The system has a second chill roller downstream of the second adhesive pattern applicator. The second chill roller is configured to allow for the face stock to mate with the liner such that each of the first adhesive and the second adhesive is sandwiched between the face stock and the liner. The system comprises at least one non-stick roller configured to convey the face stock, together with the first adhesive transferred thereto, to the second chill roller. The first adhesive is a hot temperature adhesive and the second adhesive is a cold temperature adhesive; alternately, the first adhesive is a cold temperature adhesive and the second adhesive is a hot temperature adhesive.

In another embodiment, a method for making a dual temperature label having a face stock and a liner comprises using a first adhesive pattern applicator to apply a first adhesive to the liner. The method includes transferring the first adhesive from the liner to the face stock via a first chill roller. The method comprises using a second adhesive pattern applicator to apply a second adhesive to the liner after the first adhesive has been transferred therefrom to the face stock. The method includes bringing the face stock in registry with the liner via a second chill roller to make the dual temperature label such that each of the first adhesive and the second adhesive is sandwiched between the face stock and the liner. The first adhesive is a hot temperature adhesive and the second adhesive is a cold temperature adhesive; alternately, the first adhesive is a cold temperature adhesive and the second adhesive is a hot temperature adhesive.

In yet another embodiment, a method of making a dual temperature label having a face stock and a liner comprises computing a ratio of a hot adhesive to a cold adhesive based on a temperature range to be encountered by the label. The method includes disposing each of a hot adhesive and the cold adhesive on the liner based on the computed ratio. The method includes removably adhering the liner to the face stock. The hot adhesive and the cold adhesive are non-overlapping.

BRIEF DESCRIPTION OF THE SEVERAL VIEWS OF THE DRAWINGS

Illustrative embodiments of the present disclosure are described in detail below with reference to the attached drawing figures and wherein.

DETAILED DESCRIPTION

A label is commonly adhered to an item to identify and/or provide information about that item. A shipping label adhered to a package, for example, may identify the recipient of the package and include information about the recipient's address. A food label adhered to a food item or its packaging may identify the food item and list nutritional facts relating thereto. A medicine label adhered to a pill bottle may list the active ingredients of the medicine and include directions for consuming same. And so on.

Figure 1A:
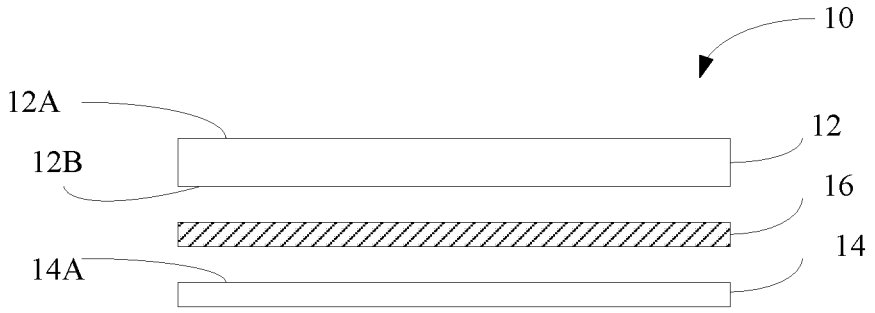
FIG 1A PRIOR ART
FIG. 1A is a cross-sectional view of a PRIOR ART label.

In the prior art, a label designed to withstand temperature extremes is configured either for hot environments or for cold environments. FIG. 1A shows a typical prior art label 10 configured for use in hot environments (i.e., a high temperature label or a hot temperature label). The label 10 has a face stock 12, a liner 14, and an adhesive 16 adapted for use in hot environments. An adhesive adapted for use in hot environments, such as the adhesive 16, may be interchangeably referred to herein as a "high temperature adhesive" or a "hot temperature adhesive."

The face stock 12, e.g., an upper surface 12A thereof, is configured for the printing of indicia. The liner 14, e.g., an upper surface 14A thereof, contains silicone or another release material. The upper surface of the liner 14A is secured to a lower surface 12B of the face stock 12 via the high temperature adhesive 16. The securement is releasable, i.e., the liner 14 may be easily disassociated from the face stock 12 by virtue of the release material on the liner upper surface 14A.

The high temperature adhesive 16 may, for example, be a hot melt adhesive. Alternately or in addition, the high temperature adhesive 16 may be an acrylic adhesive or another suitable adhesive (e.g., a suitable non-toxic pressure sensitive adhesive configured to withstand high temperatures). The skilled artisan understands that all adhesives have associated therewith a service temperature range within which the adhesive optimally functions. This service temperature range may be delineated herein using a minimum temperature MinT and a maximum temperature MaxT. Assume, for the purposes of illustration, that the service temperature range of the adhesive 16 is from −20° F. to 400° F. (i.e., the MinT is −20° F. and the MaxT is 400° F.).

Figure 1B:
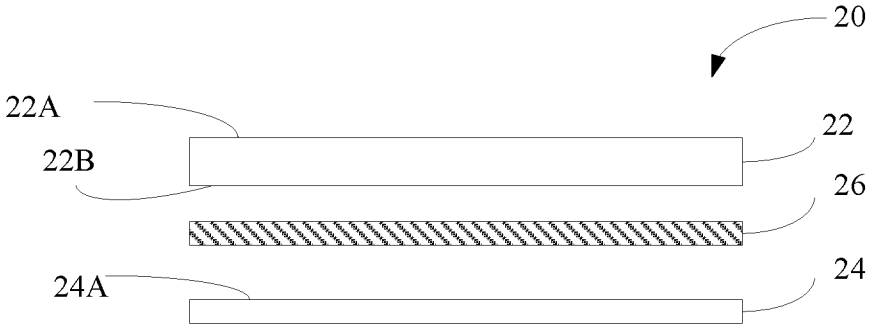
FIG 1B PRIOR ART
FIG. 1B is a cross-sectional view of another PRIOR ART label.

FIG. 1B shows a typical prior art label 20 configured for use in cold environments (i.e., a cold temperature label or a low temperature label). The label 20 has a face stock 22, a liner 24, and an adhesive 26 configured for use in cold environments. An adhesive configured for used in cold environments, such as the adhesive 26, may be interchangeably referred to herein as a "cold temperature adhesive" or a "low temperature adhesive."

The face stock 22, e.g., an upper surface 22A thereof, is configured for the printing of indicia. The liner 24, e.g., an upper surface 24A thereof, contains silicone or another release material. The upper surface of the liner 24A is releasably secured to a lower surface 22B of the face stock 22 via the cold temperature adhesive 26. The cold temperature adhesive 26 may be a hot melt adhesive, an acrylic adhesive, or another suitable adhesive. Assume, for the purposes of illustration, that the service temperature range of the adhesive 26 is from −100° F. to 170° F. (i.e., the MinT is −100° F. and the MaxT is 170° F.). It is clear that the MaxT of the high temperature adhesive 16 is substantially greater than the MaxT of the low temperature adhesive 26. Conversely, the MinT of the low temperature adhesive 26 is significantly less than the MinT of the high temperature adhesive 16.

As discussed in more detail herein, labels and/or items to which they are adhered may encounter a range of temperatures. Consider, for example, a laser printable label for a component of an electronics device that is manufactured in Kansas and is sold to a user in New York. This label may, for example, be likely to encounter: (a) a temperature of about 365° F. during the conventional laser printing process; (b) a temperature of about 250° F. during a manufacturing process; (c) a temperature of about 70° F. while the electronics device is on a store shelf in Kansas; (d) a temperature of about 20° F. when the electronics device is shipped to New York; and (e) a temperature of about 60° F. when the electronics device is brought inside the home of the end user. In this example, the minimum temperature encountered by the label is 20° F. and the maximum temperature encountered by the label is 365° F. Thus, the artisan may use the hot temperature label 10 for this application because all the temperatures likely to be encountered by the label are within the service temperature range of the label 10.

Consider now a label for use in a cryogenic application, e.g., a label for identifying a vial to be placed in a cryogenic chamber. This label may likewise encounter a range of temperatures. For example, the label may be likely to encounter: (a) a temperature of 65° F. during shipping of the label; (b) a temperature of 165° F. during a thermal printing process; (c) a temperature of −90° F. while the vial together with the label is placed inside a cryogenic chamber; and (d) a temperature of about −20° F. when the vial is stored in a freezer. In this example, the minimum temperature encountered by the label is −90° F. and the maximum temperature encountered by the label is 65° F. The artisan may therefore use the cold temperature label 20 for this application because all the temperatures likely to be encountered by the label are within the service temperature range of the label 20.

The prior art high temperature label 10 and low temperature label 20 are suitable for a number of high temperature and low temperature applications, respectively. However, the inability of the high temperature label 10 to withstand extremely cold temperatures and the inability of the low temperature label 20 to withstand extremely high temperatures substantially limits the applications in which these labels can be used.

Consider, for example, a scenario where a label manufacturer (or other entity) desires to print indicia on a cold temperature label using a laser printer. Laser printers are widely considered to be the most efficient type of printers. For example, laser printers print documents faster than traditional inkjet and other printers and use less ink as compared to the other printers. Laser printers are also easier to clean and maintain. And importantly, the print quality of laser printers is excellent and typically surpasses the print quality of conventional inkjet and other printers. For these reasons, a label manufacturer may desire to use a laser printer to print indicia on a cold temperature (e.g., a cryogenic) label.

As is known, the fuser assembly of a conventional laser printer (e.g., a personal, office, or workgroup laser printer) comprises rollers, at least one of which is heated during the printing process. The heat from the fuser, together with the pressure applied to the substrate (e.g., paper) passing through the fuser rollers, melts the toner powder and causes it to fuse with the fibers of the substrate. During the printing process, the temperature of the fuser assembly of conventional laser printers typically exceeds 365 degree Fahrenheit, and may be about as high as 392 degree Fahrenheit. If the label manufacturer were to print the cold temperature label 20 using a laser printer, the adhesive 26 would encounter temperatures that are outside the service temperature range of the label 20 (i.e., the temperature in the laser printer would be higher than the MaxT of the adhesive 26 of the label 20). The cold temperature adhesive 26, when subjected to such high temperatures, may flow, ooze out, and/or otherwise deteriorate, which may adversely impact the adhesion between the liner 24 and the face stock 22 and render the label 20 unsuitable for use. Such may be undesirable. The label manufacturer may likewise be unable to use the hot temperature label 10 for this application because the hot temperature adhesive 16, when subjected to extremely cold temperatures (e.g., in the cryogenic chamber), may become brittle and lose its efficacy.

Consider now a scenario where a label manufacturer (or other entity) desires to create a laser printable label that can be adhered to an item being shipped to a location having extremely cold ambient temperatures (e.g., to Alaska, to New York during the winter time, etc.). The label manufacturer may start with the high temperature label 10 because the high temperatures encountered within the laser printer are within the service temperature range of the high temperature adhesive 16. However, when the label 10 is adhered to an object and shipped to a location having an extremely cold ambient temperature (e.g., −50° F. or another temperature outside the service temperature range of the adhesive 16), the hot temperature adhesive 16 may, because of the extremely cold temperature, become hard, brittle, and fall off. Such may adversely impact the adhesion between the liner 14 and the face stock 12 and render the label 10 unsuitable for use. Such may be undesirable. The label manufacturer may likewise be unable to use the cold temperature label 20 for this application because the high temperatures encountered by the cold temperature label 20 within the laser printer may cause the adhesive 26 thereof to flow and ooze out of the label.

It is thus clear that neither of the prior art labels 10 and 20 may be used in applications where the label is going to encounter temperatures at both extremes. The prior art does not include adhesives suitable for use in the label industry (e.g., adhesives that are non-toxic, are suitably priced in relation to the expected cost of the label, etc.) that can withstand both hot and cold extremes (e.g., withstand 400 degree Fahrenheit and −100 degree Fahrenheit). The present disclosure may, among other things, provide for a label that is usable in both hold and cold extremes.

Figure 2:
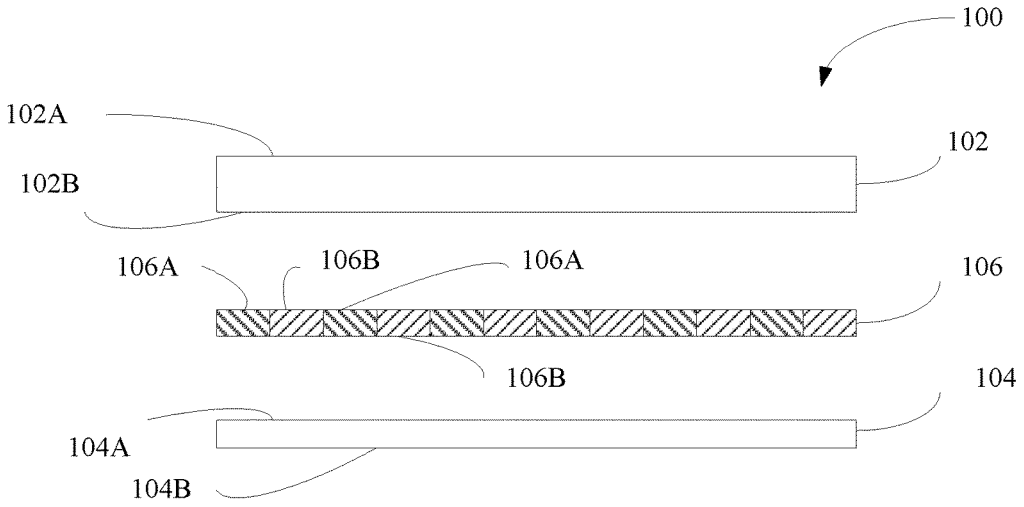
FIG. 2 is a cross-sectional view of a dual temperature label, according to an embodiment of the present disclosure.

Focus is directed now to FIG. 2 which shows an example dual temperature label 100, according to an embodiment. The label 100 may include a face stock 102, a release liner 104, and an adhesive layer 106. The face stock 102 may comprise paper, cloth, or any other material suitable for use in the label 100, and have an upper printable surface 102A and a lower surface 102B. The release liner 104 may likewise be any release liner now known or subsequently developed configured to be removably adhered to the face stock 102, and may include an upper surface 104A comprising a release material and a lower surface 104B. The adhesive layer 106 may lie between the face stock lower surface 102B and the release liner upper surface 104A.

The adhesive layer 106 may include each of a hot temperature adhesive 106A and a cold temperature adhesive 106B. The hot temperature adhesive 106A may be, for example, a hot melt adhesive, an acrylic adhesive, or any other adhesive (e.g., adhesive 16) usable in hot extremes and suitable for use in the label industry. The cold temperature adhesive 106B may likewise be a hot melt adhesive, an acrylic adhesive, or any other adhesive (e.g., adhesive 26) usable in cold extremes and suitable for use in the label industry. In some embodiments, the high temperature adhesive may be of one type (e.g., be a hot melt adhesive) and the low temperature adhesive may be of another type (e.g., be an acrylic adhesive).

The phrase "hot (or high) temperature adhesive", as used herein, refers to an adhesive whose: (a) MinT is greater than or equal to −20 degrees Fahrenheit; and (b) MaxT is greater than 320 degrees Fahrenheit. The phrase "cold (or low) temperature adhesive", as used herein, refers to an adhesive whose: (a) MaxT is less than or equal to 100 degrees Fahrenheit; and (b) MinT is less than −80 degrees Fahrenheit. Each of the hot temperature adhesive and the cold temperature adhesive expressly exclude adhesives that are not suited for use in the label industry, e.g., are toxic, exponentially increase the cost of the labels, etc. The artisan understands that many cold temperature adhesives and hot temperatures adhesives, as defined herein, are commercially available for use in the label industry.

The phrase "dual temperature label", as used herein, refers to a label whose liner and/or face stock contains both a hot temperature adhesive and a cold temperature adhesive. The artisan will appreciate from the disclosure herein that a dual temperature label may be used in applications involving hot extremes, applications involving cold extremes, and applications involving any temperature in between.

Figure 3:
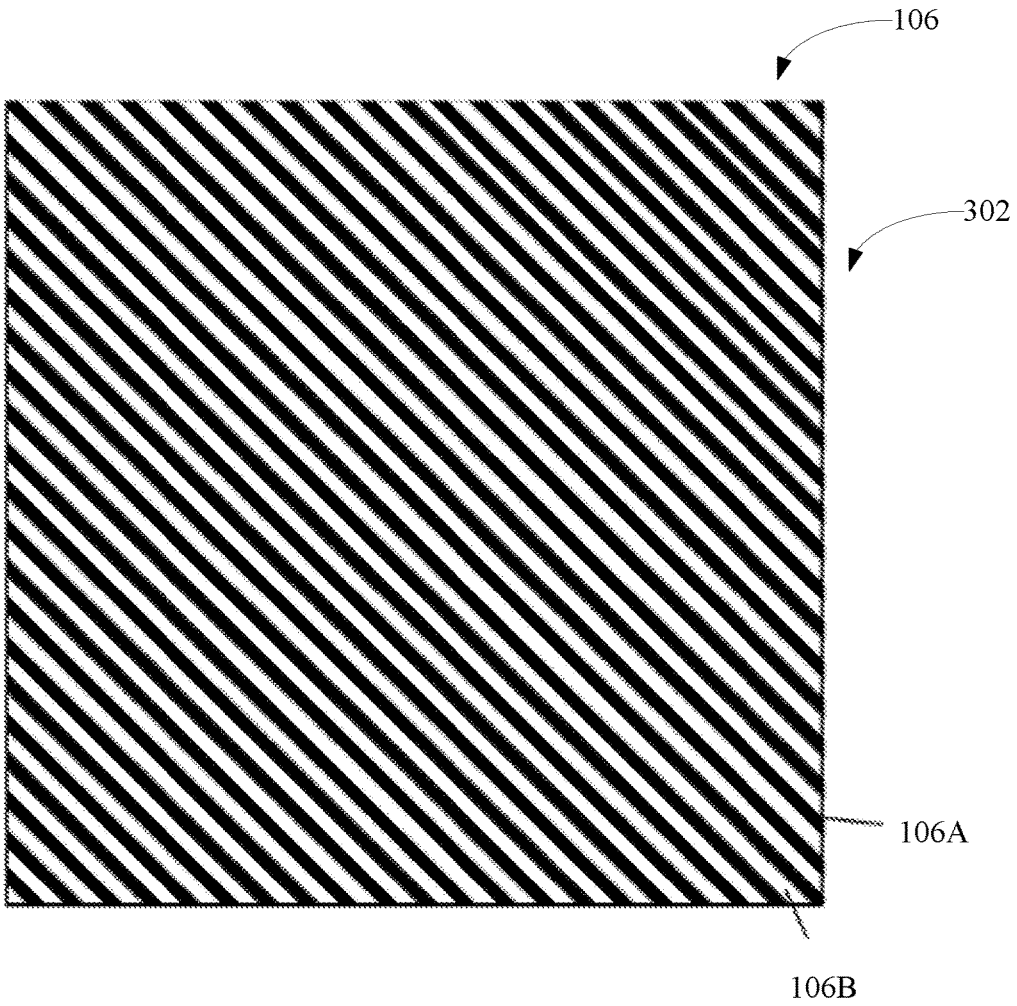
FIG. 3 is an overhead view of an adhesive layer of the dual temperature label of FIG. 2.

FIG. 3 shows the adhesive layer 106 in additional detail. As can be seen, the adhesive 106 is arranged in the FIG. 3 example as a pattern 302. The pattern 302 comprises a plurality of strips of each of the hot temperature adhesive 106A (represented in FIG. 3 by black lines) and the cold temperature adhesive 106B (represented in FIG. 3 by white lines) arranged in a side-by-side pattern. The adhesive layer 106 may allow for the label 100 to be used in both hot extremes and cold extremes. For example, if the label 100 were to be printed in a laser printer, the hot temperature adhesive 106A may ensure that the liner 104 remains adhered to the face stock 102 notwithstanding the extremely high temperatures encountered in the laser printer. Similarly, if the same label 100 is thereafter (or at any time) used in a cold environment, e.g., is placed on a vial in a freezer, the cold temperature adhesive 106B may ensure continued adhesion between the liner 104 and the face stock 102. Employing the pattern 302 that comprises at least one adhesive suited to high temperature extremes and at least one adhesive suited to cold temperature extremes may allow the label 100 to function as desired in both (or either) extremes.

Users of prior art labels often complain about the lifting or curling of the face stock. Such may happen, for example, when the adhesive covering an edge of the label fails (e.g., becomes too brittle, oozes out, etc.), thereby causing the corresponding face stock edge to undesirably disassociate from the liner. The pattern 302 depicted in FIG. 3 may serve to alleviate this concern. Specifically, each of the strips of the hot temperature adhesive 106A and the strips of the cold temperature adhesive 106B are arranged in the example pattern 302 in a forty-five degree angle to the horizontal. This forty-five degree angle of the strips of the hot temperature adhesive 106A and the cold temperature adhesive 106B may ensure that all four edges of the label (e.g., of the face stock 102 and the liner 104) include both the hot temperature adhesive 106A and the cold temperature adhesive 106B. Thus, even if one adhesive fails (e.g., if the hot temperature adhesive 106A fails because the label 100 is placed in a frigid environment), the other adhesive may ensure that the edges (and the remainder of) the face stock 102 remains suitably adhered to the liner 104. In some embodiments, the hot temperature adhesive 106A and the cold temperature adhesive 106B in the pattern 302 may be non-overlapping.

The ratio of the hot temperature adhesive 106A and the cold temperature adhesive 106B in the pattern 302 in FIG. 3 is generally equal. That is, the adhesive layer 106 generally comprises 50% hot temperature adhesive 106A and 50% cold temperature adhesive 106B. Such, however, is merely exemplary. Embodiments of the present disclosure include labels having both hot and cold temperature adhesives in differing ratios.

Figure 4:
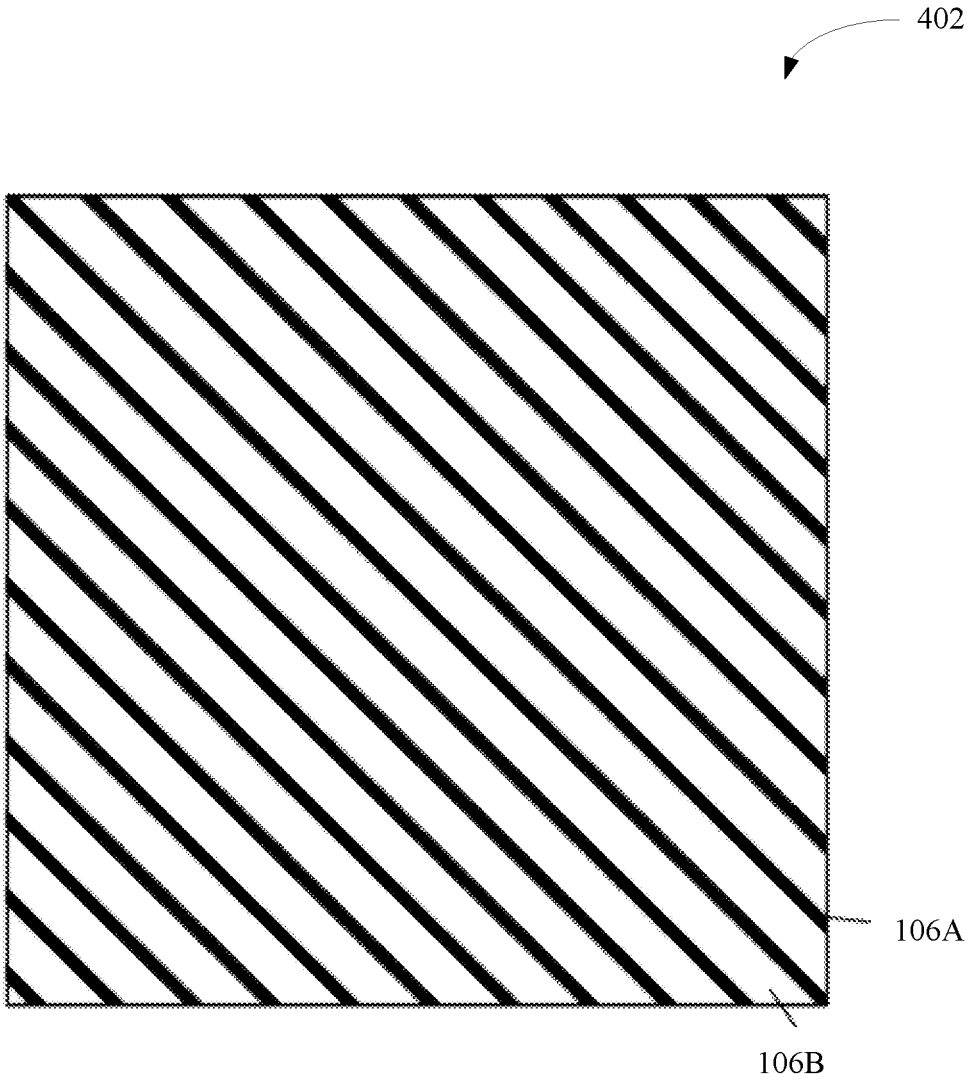
FIG. 4 is an overhead view of another adhesive layer usable in the dual temperature label of FIG. 2.

FIG. 4 shows an example adhesive layer or pattern 402. As can be seen, the adhesive pattern 402, like the adhesive pattern 302, includes strips of hot temperature adhesive 106A and cold temperature adhesive 106B. However, the strips of the hot temperature adhesive 106A in the pattern 402 are smaller than the strips of the cold temperature adhesive 106B such that the ratio of hot temperature adhesive 106A and the cold temperature adhesive 106B is 1:3. Because the pattern 402 includes a greater amount of cold temperature adhesive 106B than hot temperature adhesive 106A, it may be used in labels that will encounter cold environments more than hot environments. In the same vein, where a label is to encounter more hot environments than cold environments, the pattern may include a greater amount of hot temperature adhesive 106A than cold temperature adhesive 106B. For example, where the label has a shelf life of one year, is likely to be exposed to cold temperatures for three of the twelve months, and is likely to be exposed to hot temperatures for the other nine of the twelve months, the ratio of the hot temperature adhesive 106A and cold temperature adhesive 106B may be 3:1. Or, for instance, where the label 100 is likely to encounter cold temperature extremes but is unlikely to encounter hot temperature extremes, the ratio of the hot temperature adhesive 106A and the cold temperature adhesive 106B may be 5:95. In some embodiments, the ratio of the hot temperature adhesive 106A and the cold temperature adhesive 106B may be computed based on one or more additional factors, e.g., the type of surface to which the label 100 is to be applied, the conditions at the time of application of the label 100, etc.

While FIGS. 3 and 4 each show the strips of adhesive 106A and 106B being arranged in a 45 degree angle to the horizontal, the artisan will appreciate from the disclosure herein that such is merely exemplary. Indeed, the adhesive patterns depicted in FIGS. 3 and 4, together with the ratios of the hot temperature adhesives 106A and cold temperature adhesives 106B illustrated therein, are merely exemplary and are not intended to be independently limiting. For example, depending on the application, the adhesive pattern may include strips (or dots, squares, circles, etc.) of hot temperature adhesive 106A and cold temperature adhesive 106B that extend vertically, horizontally, or in any other symmetrical or non-symmetrical manner. Similarly, the hot temperature adhesive 106A and cold temperature adhesive 106B may be in any perceivable ratio (e.g., where the label is likely to encounter primarily or only hot extremes, the pattern may comprise 99% hot temperature adhesive 106A and 1% cold temperature adhesive). There is no requirement that the entire surface of the face stock and/or liner be covered with adhesive; for instance, the adhesive layer may be pulled back (e.g., an eighth of an inch, a sixteenth of an inch, etc.) from one or more edges of the label. Furthermore, in embodiments, the adhesive layer may include void spaces (i.e., spaces devoid of any adhesive).

Embodiments of the present disclosure include labels having adhesive disposed thereon in a flow blocking pattern. The term "flow blocking pattern", as used herein, refers to a pattern or section of hot temperature adhesive that fully or partially encapsulates a pattern or section of cold temperature adhesive to preclude (or at least inhibit) the cold temperature adhesive from flowing out of the label. That is, a flow blocking pattern refers to a pattern of adhesive having a hot temperature adhesive adapted to preclude or at least inhibit a flow of a cold temperature adhesive.

Figure 5:
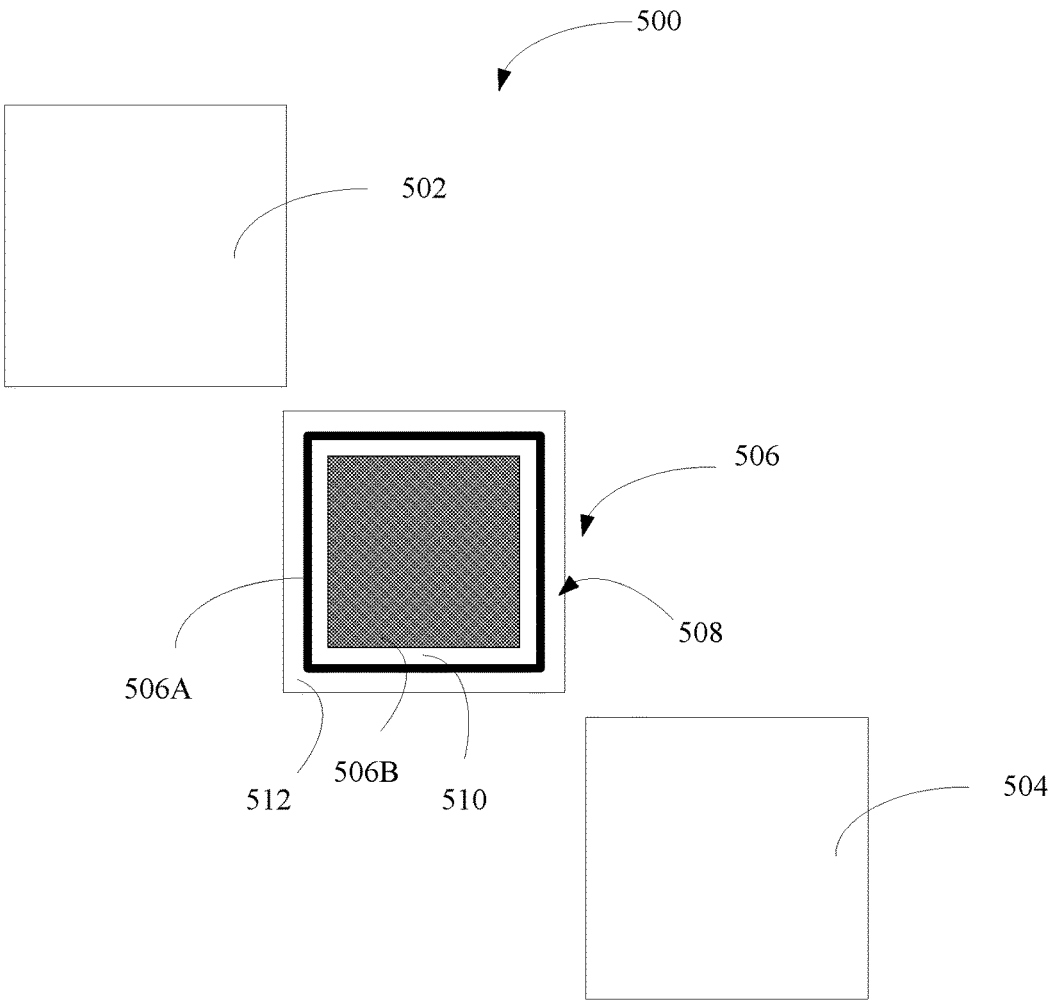
FIG. 5 is an overhead view of a laser printable cryogenic label, according to an embodiment.

FIG. 5 illustrates these concepts in additional detail. Specifically, FIG. 5 shows a laser printable cryogenic dual temperature label 500 having a face stock 502, a liner 504, and an adhesive layer 506, according to an embodiment. The face stock 502 may be configured for the printing of indicia, and the liner 504 may be have a release material disposed thereon to allow the release liner 504 to be releasably secured to the face stock 502 via the adhesive 506.

The adhesive 506 includes both a cold temperature adhesive and a hot temperature adhesive. In FIG. 5, a hot temperature adhesive 506A is represented by a bold line and a cold temperature adhesive 506B is represented by a dot pattern. As can be seen, example flow blocking pattern 508 includes a perimeter or boundary comprising a hot temperature adhesive 506A that encapsulates the cold temperature adhesive 506B disposed inwardly adjacent thereto. The example adhesive layer 506 may contain a void space 510 between the hot temperature adhesive 506A and the cold temperature adhesive 506B; and, the adhesive layer 506 may be pulled inward from the edges, leaving a blank space 512 between the label edges and the hot temperature adhesive 506A. Such, however, is merely exemplary and is not required for a pattern to be considered a flow blocking pattern. For example, the flow blocking pattern may include a hot temperature adhesive that surrounds and is in contact with a cold temperature adhesive.

The adhesive pattern 508, specifically the perimeter hot temperature adhesive 506A thereof, may block or at least impede the flow of the cold temperature adhesive 506B to a surface outside the label. More specifically, when the cryogenic label 500 is placed in a laser printer for printing, the label 500 may encounter extremely high temperatures (e.g., temperatures well above the MaxT of the cold temperature adhesive 506B). These high temperatures encountered by the label 500 within the laser printer (or elsewhere) may cause the cold temperature adhesive 506B to invariably flow. If the hot perimeter adhesive 506A was not provided, the cold temperature adhesive 506B may have the tendency to flow and ooze out of label 500, which may be undesirable. The hot perimeter adhesive 506A of the pattern 508 may act as a barrier that precludes or at least inhibits such flow of the cold temperature adhesive 506B and thereby ensure that the cold temperature adhesive 506B remains available for use in the label 500 after the label 500 leaves the extreme hot environment.

Figure 6:
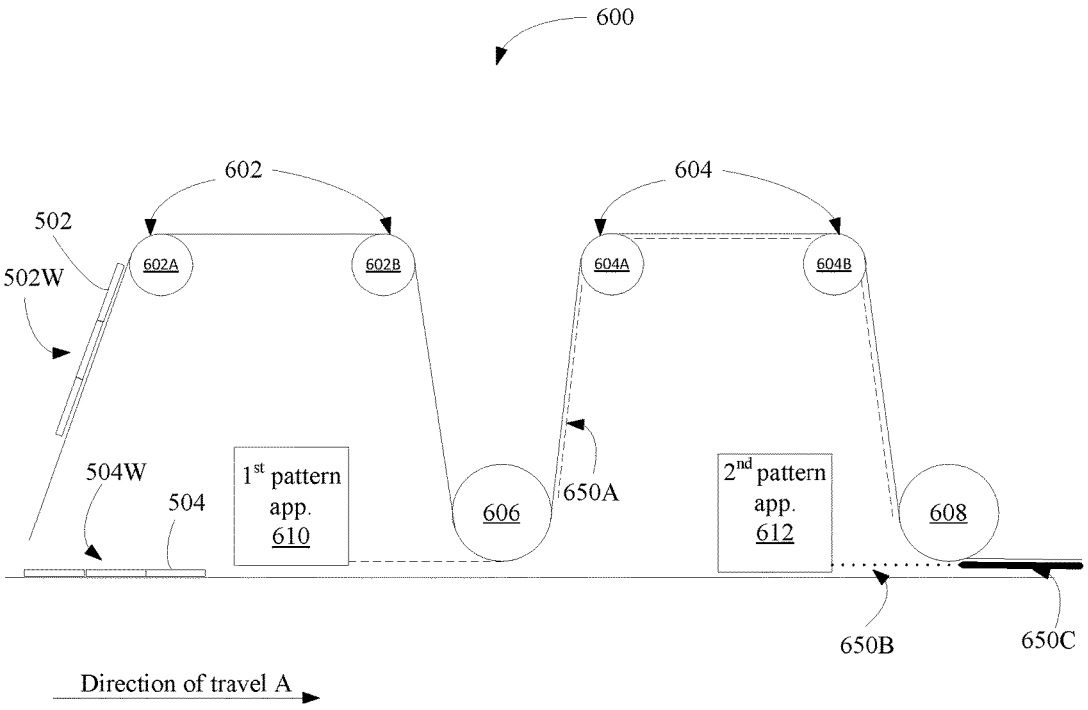
FIG. 6 is schematic representation of an example system for making dual temperature labels, such as the labels of FIGS. 2 and 5.

FIG. 6 shows an example apparatus 600 for manufacturing the inventive dual temperature labels discussed herein (e.g., the label 100, the label 500, or any other label having both hot and cold temperature adhesive as defined herein). The dual temperature label making apparatus 600 may include a first pair of rollers 602, a second pair of rollers 604, chill rollers 606 and 608, a first (or upstream) adhesive pattern applicator 610, and a second (or downstream) adhesive pattern applicator 612.

The first pair of rollers 602 includes rollers 602A and 602B. The first pair of rollers 602 need not be non-stick rollers. The second pair of rollers 604 includes two rollers 604A and 604B, each of which may be non-stick rollers (e.g., have silicone or other release material disposed thereon). The first adhesive pattern applicator 610 may include programmable rollers or other means to allows for application of a pattern of adhesive (i.e., of one of the hot temperature adhesive and the cold temperature adhesive) onto the liner, as discussed herein. The second adhesive pattern applicator 612 may include a programmable rollers or other means to allow for application of a pattern of adhesive (i.e., of the other of the hot temperature adhesive and the cold temperature adhesive) onto the liner. The artisan will understand from the disclosure herein that the adhesives may be applied by the first pattern applicator 610 and the second pattern applicator 612 in varying patterns.

FIG. 6 illustrates the workings of the system 600 in a left to right direction A; the artisan will understand that such, however, is merely exemplary. In the illustrated example, (a) the first pattern applicator 610 is upstream of the first chill roller 606, the second chill roller 608, and the second pattern applicator 612; and (b) the first chill roller 606 is upstream of the second pattern applicator 612 and the second chill roller 608.

Figure 7:
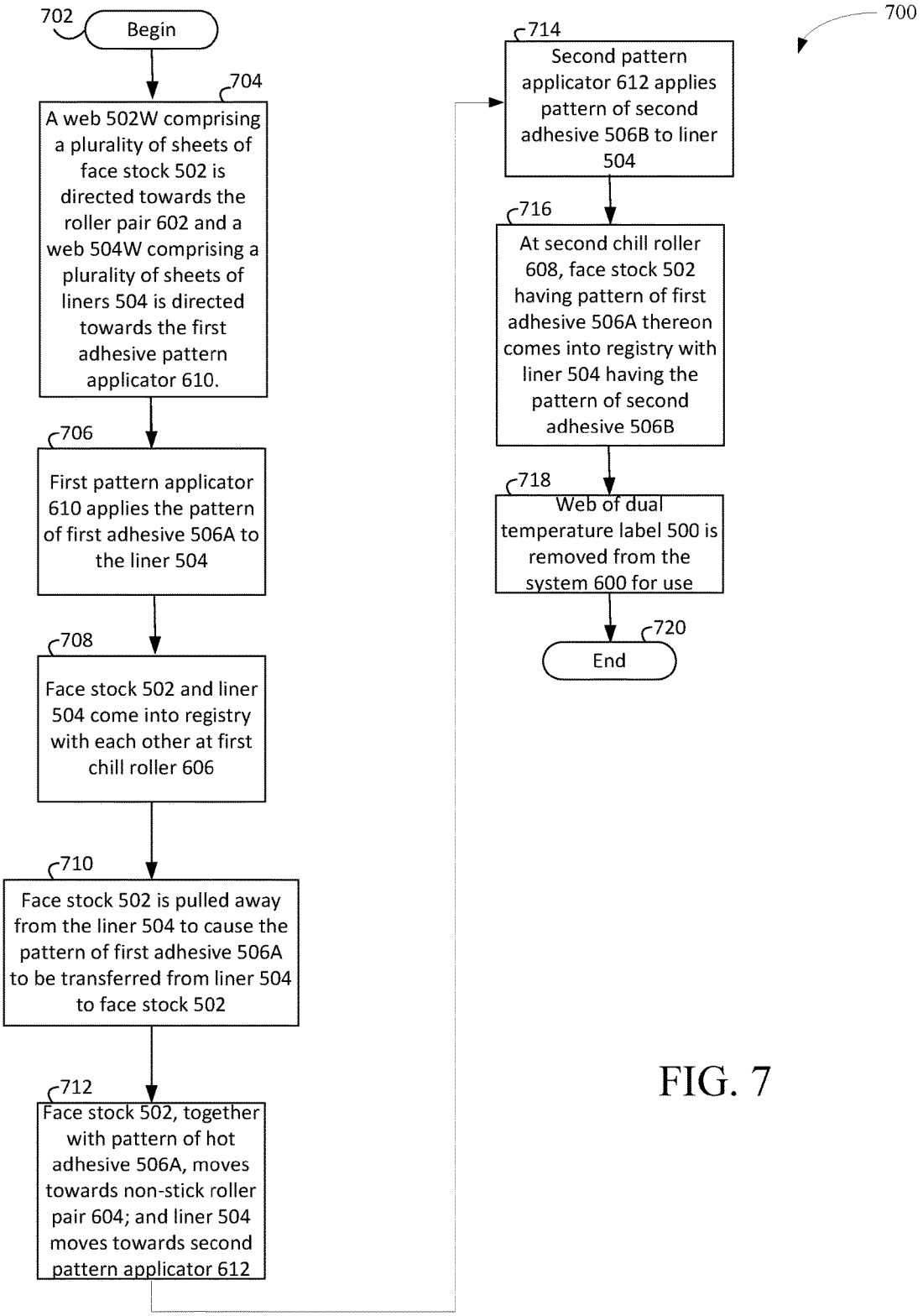
FIG. 7 is a flowchart illustrating a method of using the system of FIG. 6 to make the dual temperature label of FIG. 5.

To illustrate the workings of the dual temperature label making apparatus 600 in more detail, focus is directed also to FIG. 7, which shows a method 700 of making a dual temperature label. While the method 700 is directed to making the cryogenic label 500 of FIG. 5, the artisan will appreciate that the apparatus 600 may be used to make other dual temperature labels (e.g., any of the dual temperature labels disclosed herein).

The method 700 may begin at step 702. At step 704, a web 502W comprising a plurality of sheets of face stock 502 may be directed towards the roller pair 602 and a web 504W comprising a plurality of sheets of liners 504 may be directed towards the first adhesive pattern applicator 610. While the dual temperature label making process is illustrated herein with reference to one face stock 502 of the face stock web 502W and one liner 504 of the liner web 504W, the artisan will understand that all sheets of face stock 502 in the face stock web 502W and all sheets of liners 504 in the liner web 504W may undergo the same process to create a plurality of dual temperature labels 500 from the face stock web 502W and the liner web 504W.

At step 706, the first pattern applicator 610 may apply the first adhesive (e.g., one of the hot temperature adhesive 506A and the cold temperature adhesive 506B) to the liner 504 (e.g., to one of the liners 504 in the web 504W). Assume, solely for the purposes of illustration, that the first pattern applicator is configured for the application of the hot temperature adhesive 506A. Dashed line 650A in FIG. 6 represents the movement of the pattern of hot temperature adhesive 506A in the system 600 after it is applied to the liner 504.

At step 708, once the first pattern applicator 610 has applied the pattern of hot temperature adhesive 506A (i.e., a perimeter pattern in this example, see FIG. 5) to the liner 504, one face stock 502 in the face stock web 502W and one liner 504 in the liner web 504W may come into registry with each other at the first chill roller 606. That is, the face stock 502 may come atop and contact a corresponding liner 504 such that the pattern of hot temperature adhesive 506A is sandwiched therebetween. At step 710, the face stock 502 may be pulled away from the liner 504 via the first chill roller 606 to cause the pattern of first adhesive 506A to be transferred from liner 504 to the corresponding face stock 502. The transfer may include all (or in embodiments, most) of the hot temperature adhesive 506A and may be facilitated by the release material on the liner 504.

At step 712, the face stock 502 (and the web 502W), together with the pattern of hot temperature adhesive 506A thereon, may travel towards the non-stick roller pair 604. Meanwhile, the liner 504 (together with the web 504W), from which the pattern of hot temperature adhesive 506A has been removed (i.e., transferred), may travel towards the second pattern applicator 612. The temporary removal of the adhesive 506A disposed on the liner 504 by the first pattern application 610 may ensure that the liner 504 does not undesirably adhere to and/or damage the components of the second pattern applicator 612. The fact that the roller pair 604 includes non-stick rollers may preclude the face stock 502 from undesirably adhering thereto.

At step 714, the second pattern applicator 612 may apply the pattern of cold temperature adhesive 506B to the liner 504. Dotted line 650B in FIG. 6 represents the movement of the pattern of cold temperature adhesive 506B in the system 600 after it is applied to the liner 504.

At step 716, the face stock 502 (which has the pattern of hot temperature adhesive 506A thereon) may come into registry with the liner 504 (which has the pattern of cold temperature adhesive 506B thereon) and become releasably secured thereto at the second chill roller 608. That is, at this point, the label 500 may contain the pattern 508 (or another pattern) containing both the pattern of hot temperature adhesive 506A and the pattern of cold temperature adhesive 506B. Bold line 650C represents the patterns of both the hot temperature adhesive 506A and the cold temperature adhesive 506B sandwiched between the face stock 502 and the liner 504. At step 718, the web of dual temperature labels 500 may be pulled from the system 600 for use (e.g., the web of labels 500 may be directed the system 600 to a laser printer or elsewhere). The method 700 may then end at step 720.

In embodiments, the web 502W of face stock 502 fed to the system 600 may have no die cuts (or perforations or other such demarcations) and the web 504W of liners 504 fed to the system 600 may likewise have no die cuts (or perforations or other such demarcations). Alternately, the web 502W of face stock 502 and/or the web 504W of liners 504 may have no die cuts (or perforations or other demarcations) that extend laterally across the respective webs. The system 600 may take in the face stock web 502W and the liner web 504W, and place the first adhesive 506A and the second adhesive 506B on the liner web 504W as discussed herein. The face stock web 502W may then be brought into registry with the liner web 504W at the second chill roller 608 to create a combined web comprising each of the face stock web 502W and the liner web 504W. The combined web may then be die cut, perforated, or otherwise manipulated to define the individual labels 500. The labels 500 may, for example, be arranged in a roll, or may be stacked for post-processing (e.g., printing).

In this way, the system 600 may allow for manufacturing dual temperature labels (e.g., label 500, label 100, etc.) quickly and inexpensively.

While the disclosure above provides some examples applications for the dual-temperature labels disclosed herein, the artisan will understand that these examples are not intended to be independently limiting. Indeed, the dual temperature labels may be used in any label application where the label is likely to be exposed to both hot and cold temperature extremes. Moreover, while the disclosure above focuses on a label having a solitary and planar face stock and liner ply, such too is merely exemplary. Embodiments of the present disclosure include any and all labels (e.g., double sided labels, fold-under labels, etc.) that are likely to encounter both hot and cold extremes and on which both hot and cold temperature adhesives may be disposed. In a currently preferred embodiment, neither of the hot temperature adhesive and the cold temperature adhesive is a silicone adhesive, as silicone adhesive is known to be toxic to humans and is harmful to the environment (and is therefore unsuitable for use in the label industry). In one embodiment, both the hot temperature adhesive and the cold temperature adhesive are hot melt adhesives. In one embodiment, both the hot temperature adhesive and the cold temperature adhesive are removable adhesives.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Not all steps listed in the various figures need be carried out in the specific order described.

The disclosure claimed is:

1. A method for making a dual temperature label, the label having a face stock and a liner, the method comprising:

providing a label making system, comprising:

a first adhesive pattern applicator configured to apply a first adhesive to said liner;

a second adhesive pattern applicator downstream of said first adhesive pattern applicator and being configured to apply a second adhesive to said liner;

a first chill roller upstream of said second adhesive pattern applicator;

a second chill roller downstream of said second adhesive pattern applicator;

using said first adhesive pattern applicator to apply said first adhesive to said liner;

transferring said first adhesive from said liner to said face stock via said first chill roller;

using said second adhesive pattern applicator to apply said second adhesive to said liner after said first adhesive has been transferred therefrom to said face stock; and bringing said face stock in registry with said liner via said second chill roller to make said dual temperature label such that each of the first adhesive and the second adhesive is sandwiched between said face stock and said liner;

wherein: (a) said first adhesive is a hot temperature adhesive and said second adhesive is a cold temperature adhesive; or (b) said first adhesive is a cold temperature adhesive and said second adhesive is a hot temperature adhesive.

2. The method of claim 1, wherein said label making system further comprises a first pair of rollers and a second pair of rollers; said first pair of rollers being upstream of said first chill roller; said second pair of rollers being downstream of said first chill roller.

3. The method of claim 2, wherein:

each of said second pair of rollers includes a release material;

said face stock is a part of a first web; and said liner is a part of a second web.

4. The method of claim 1, wherein said first adhesive encapsulates said second adhesive after said face stock and said liner are brought into registry with each other via the second chill roller.

5. The method of claim 1, wherein said first adhesive and said second adhesive collectively form a flow blocking pattern.

6. The method of claim 5, wherein said first adhesive and said second adhesive are non-overlapping.

7. The method of claim 1, further comprising controlling a ratio of said first adhesive to said second adhesive based on a range of temperatures.

8. The method of claim 1, wherein:

said label has four edges; and each of said four edges includes each of said first adhesive and said second adhesive.

9. The method of claim 1, further comprising controlling a ratio of said first adhesive to said second adhesive based on a range of temperatures.

10. A system for making a dual temperature label, the label having a face stock and a liner, the system comprising:

a first adhesive pattern applicator configured to apply a first adhesive to said liner;

a second adhesive pattern applicator downstream of said first adhesive pattern applicator configured to apply a second adhesive to said liner;

a first chill roller downstream of said first adhesive pattern applicator; said first chill roller configured to allow for said first adhesive applied to said liner to be transferred to said face stock;

a second chill roller downstream of said second adhesive pattern applicator; said second chill roller configured to allow for said face stock to mate with said liner such that each of said first adhesive and said second adhesive is sandwiched between said face stock and said liner; and at least one non-stick roller configured to convey said face stock, together with said first adhesive transferred thereto, to said second chill roller;

wherein: (a) said first adhesive is a hot temperature adhesive and said second adhesive is a cold temperature adhesive; or (b) said first adhesive is a cold temperature adhesive and said second adhesive is a hot temperature adhesive.

11. The system of claim 10, wherein said at least one-stick roller includes a pair of non-stick rollers.

12. The system of claim 11, further comprising a roller pair upstream of said pair of non-stick rollers; said roller pair being configured to convey said face stock to said first chill roller.

13. The system of claim 10, wherein said first adhesive pattern applicator and said second adhesive pattern applicator are collectively configured to create a flow blocking pattern.

14. The system of claim 13, wherein said face stock comprises cloth.

15. The system of claim 10, wherein said label is a cryogenic laser printable label.

16. A method for making a dual temperature label, the label having a face stock and a liner, the method comprising:

using a first adhesive pattern applicator to apply a first adhesive to said liner;

transferring said first adhesive from said liner to said face stock via a first chill roller;

using a second adhesive pattern applicator to apply a second adhesive to said liner after said first adhesive has been transferred therefrom to said face stock; and bringing said face stock in registry with said liner via a second chill roller to make said dual temperature label such that each of the first adhesive and the second adhesive is sandwiched between said face stock and said liner;

wherein: (a) said first adhesive is a hot temperature adhesive and said second adhesive is a cold temperature adhesive; or (b) said first adhesive is a cold temperature adhesive and said second adhesive is a hot temperature adhesive.

17. The method of claim 16, wherein said first adhesive encapsulates said second adhesive after said face stock and said liner are brought into registry with each other via the second chill roller.

18. The method of claim 16, wherein said first adhesive and said second adhesive collectively form a flow blocking pattern.

19. The method of claim 18, wherein said first adhesive and said second adhesive are non-overlapping.

20. A method of making a dual temperature label, the label having a face stock and a liner, the method comprising:

computing a ratio of a hot adhesive to a cold adhesive based on a temperature range to be encountered by said label;

disposing said hot adhesive on said liner based on said computed ratio;

disposing said cold adhesive on said liner based on said computed ratio;

removably adhering said liner to said face stock;

wherein said hot adhesive and said cold adhesive are non-overlapping.

21. The method of claim 20, wherein each of said hot adhesive and said cold adhesive is a hot melt adhesive.

22. The method of claim 20, wherein each of said hot adhesive and said cold adhesive is a removable adhesive.

* * * * *